US006935054B2

(12) United States Patent
Hall et al.

(10) Patent No.: US 6,935,054 B2
(45) Date of Patent: Aug. 30, 2005

(54) SNOWBOARD BOOT WITH REMOVABLE ANKLE SUPPORTS

(75) Inventors: William B. Hall, Seattle, WA (US); John D. Martin, Vashon, WA (US)

(73) Assignee: K-2 Corporation, Vashon, WA (US)

( * ) Notice: Subject to any disclaimer, the term of this patent is extended or adjusted under 35 U.S.C. 154(b) by 71 days.

(21) Appl. No.: 10/365,723

(22) Filed: Feb. 11, 2003

(65) Prior Publication Data

US 2003/0115777 A1 Jun. 26, 2003

Related U.S. Application Data

(63) Continuation-in-part of application No. 09/765,867, filed on Jan. 19, 2001, now abandoned, which is a continuation-in-part of application No. 09/760,326, filed on Jan. 12, 2001, now Pat. No. 6,519,877.

(51) Int. Cl.[7] ..... A43B 5/04

(52) U.S. Cl. ..... 36/117.1; 36/117.6; 36/89; 36/107; 36/119.1; 36/58.5

(58) Field of Search ..... 36/117.1, 119.1, 36/88, 89, 45, 54, 115, 114, 136, 109, 107, 117.6, 58.5, 58.6

(56) References Cited

U.S. PATENT DOCUMENTS

| | | | | | |
|---|---|---|---|---|---|
| 5,265,353 | A | * | 11/1993 | Marega et al. | 36/54 |
| 5,575,090 | A | * | 11/1996 | Condini | 36/54 |
| 5,606,808 | A | * | 3/1997 | Gilliard et al. | 36/89 |
| 5,819,440 | A | * | 10/1998 | Okajima | 36/117.1 |
| 6,360,454 | B1 | * | 3/2002 | Dachgruber et al. | 36/54 |
| 6,519,877 | B2 | * | 2/2003 | Oetting et al. | 36/117.1 |

* cited by examiner

*Primary Examiner*—Jila M. Mohandesi
(74) *Attorney, Agent, or Firm*—Christensen O'Connor Johnson Kindness PLLC

(57) ABSTRACT

A snowboard boot (200) includes an upper boot (204) secured to an outsole (206). The boot upper includes a vamp opening (208) that is closed by a tongue (210) and a selectively securable vamp fastener (216). The tongue (210) carries a pocket (218) on a lower end (212) thereof, and first and second snap fasteners (222) on an upper end (214) thereof. A semi-rigid tongue stiffener (202) can be selectively secured to an anterior side of the tongue (210) utilizing the pocket and snap fasteners to selectively increase the stiffness of the boot and resistance to forward flexure by a predetermined degree.

18 Claims, 9 Drawing Sheets

SNOWBOARD BOOT WITH REMOVABLE ANKLE SUPPORTS

CROSS-REFERENCE TO RELATED APPLICATIONS

The present application is a continuation-in-part of U.S. application Ser. No. 09/765,867, filed Jan. 19, 2001, now abandoned, which is a continuation-in-part of U.S. patent application Ser. No. 09/760,326, filed Jan. 12, 2001, which issued as U.S. Pat. No. 6,519,877, priority from the filing date of which is hereby claimed under 35 U.S.C. § 120.

FIELD OF THE INVENTION

The present invention relates to snowboard boots and, more particularly, to snowboard boots having a flexible upper.

BACKGROUND OF THE INVENTION

Snowboarding is a popular winter sport in which a snowboarder stands atop a snowboard and maneuvers the board over the snow, propelled by gravity. The snowboarder wears boots that are removably attached to the board, with the snowboarder's feet angled with respect to the longitudinal axis of the board and, in some cases, perpendicular to the board axis. The snowboard is controlled by weight transfer and foot movement, both lateral and longitudinal.

A primary skill that must be mastered in snowboarding is the ability to carve a path through the snow, rather than simply sliding over the top of the snow. Carving allows the snowboarder to control the direction and speed of the snowboard. In its simplest execution, a snowboarder carves a path through the snow by shifting his or her weight forward or backward, causing the snowboard to tilt or rotate about its longitudinal axis toward and away from its back side edge. As used herein, front side refers to the side or direction to which the snowboarder's toes are closest and back side refers to the opposite side or direction.

Snowboard boots are conventionally secured to the board using either strap bindings or step-in bindings. In either case, the binding and/or boot usually employs a high back structure that extends upwardly from either the board or the back side of the boot sole, along and behind the ankle of the boot. The high back limits rearward flexure of the ankle so that when the snowboarder leans backwards, force is transmitted to the snowboard tending to rotate the snowboard about its longitudinal axis toward the back side edge. The high back is secured to the board in conventional strap bindings and in high back step-in bindings.

An alternative type of step-in binding is also available, called a plate or flat step-in binding. Flat step-in bindings utilize metal cleats on the bottom of the snowboard boot that mate with a binding structure built into the snowboard, to secure the snowboard boot to the snowboard. For example, two metal cleats are sometimes provided on the bottom of each boot, one toward the front portion of the boot and the other toward the heel of the boot. Step-in bindings provide many advantages over strap and high back step-in bindings, including ease of attachment and disattachment. The flat step-in binding itself, however, does not provide a connection between the snowboarder's calf and the frontside of the snowboard. Therefore, in order to facilitate back side turns, snowboard boots for use with flat step-in bindings are typically much stiffer, particularly along the vertical back portion of the upper, than are snowboard boots for strap and high back step-in bindings. The functional equivalent of the high back is essentially built into the snowboard boot for flat step-in bindings, rigidizing the rear spine of the boot against rear flexion.

The choice of binding type and boot will depend on a variety of factors. For example, in alpine snowboarding, wherein the snowboarder typically maneuvers from the top to the bottom of a snow-covered slope, it is generally preferred to have a stiffer connection between the snowboarder and the snowboard. In free style snowboarding, which typically involves performing more elaborate tricks, more mobility, and flexibility between the snowboarder and the snowboard is desirable. Two or more different pairs of snowboard boots may therefore be necessary for a snowboarder who wants to do both alpine and free style snowboarding—one pair of boots for use with strap or high back step-in bindings; another pair of boots for flat step-in bindings; and possibly a third pair of boots for use with flat step-in bindings that has a greater degree of flexibility in the ankle portion.

In U.S. Pat. No. 5,966,843 to Sand et al., a boot structure is disclosed for use with step-in bindings including an underfoot or shank portion that connects to a heel cup and high back portion. Straps are provided from the high back portion to the shank, whereby backward motion of the high back portion will cause the shank to rise. This boot essentially combines the features of a high back binding and a step-in binding into a soft boot structure.

A similar stiffening assembly is disclosed in U.S. Pat. No. 5,771,609 to Messmer, which teaches a boot insert including a rigid underfoot portion pivotally attached to a rigid back plate, and a pair of flexible tension straps extending between the back plate and the underfoot portion. Neither Messmer nor Sand et al. teaches a stiffening apparatus that can be removed from the boot.

In U.S. Pat. No. 5,606,808, Gilliard et al. teaches a snowboard boot having at least one elongate exterior pocket in the flexible upper portion of the boot with an open top channel to receive a substantially uniform rectilinear cross-sectional elongate stay for stiffening the upper portion of the boot. The stay, which is maintained in the pocket by frictional forces, includes a strap for inserting and removing the stay, whereby the snowboarder can adjust the stiffness of the boot upper portion. The elongate stay does not, however, conform to the shape of the snowboarder's ankle, and is susceptible to being inadvertently pulled out during use—for example, if the snowboarder tumbles in the snow or brushes against obstacles on the slope.

In addition to having need for differing levels of support in the rear of a snowboard boot, there are different snowboarding styles and activities that are facilitated by having a boot with differing levels of stiffness on the anterior side of the ankle, to revise the ease of forward flexure. For example, a snowboarder who rides in a free style fashion, particularly in terrain such as a half pipe or smaller jumps, typically prefers a relatively loose boot with little limitation on forward flexure. Force transmission from the user's lower leg to the toe edge of the board can be finely tuned with a responsive feel, yet requires a high degree of strength for accurate control. In contrast, a snowboarder who rides an all mountain board, particularly at fast speeds, or who tackles very large jumps, typically prefers a boot with a higher degree of stiffness in the forward direction. The wearer is more readily able to maintain control of the toe edge, particularly at high speed, and force may be more efficiently transmitted from the user's lower leg to the toe edge.

SUMMARY OF THE INVENTION

An embodiment of the present invention provides a soft sports boot having a flexible upper portion adapted to receive the foot and ankle of a user, the upper portion including an elongate vamp opening along the instep and anterior ankle of the user and a high back portion adapted to wrap about the ankle of the user, the upper portion further including a tongue disposed generally along the elongate vamp opening, and a sole joined to the upper portion. The boot includes: (i) a removable, semi-rigid ankle support system having a semi-rigid back insert that is removably attached to the upper and is adapted to partially wrap about the user's leg near a top edge of the upper; and (ii) a semi-rigid forward stiffener removably attached to the tongue and adapted to partially wrap about the front of the user's leg near the top edge of the upper portion.

An embodiment of the present invention provides a boot for snow sports having a sole portion and an upper portion that cooperatively receive a user's foot. The upper portion has a flexible high back portion adapted to surround the user's ankle. The high back portion includes a pocket that is adapted to receive a removable, semi-rigid insert that is wide at a top end and narrow at a bottom end. By installing or removing the insert in the pocket, the rearward flexibility of the high back portion of the boot can be selectively modified.

In a further aspect of the present invention, the insert is generally Y-shaped, and the high back portion of the boot also includes a pair of locking slots that is positioned to receive opposite corners of the top end of the insert, such that the insert can be removably locked in place in the pocket.

In an aspect of one embodiment of the present invention, the snowboard boot further comprises a soft liner that is insertable into the boot to improve the user's comfort.

In a further aspect of the present invention, a snowboard boot is provided that has an adjustable degree of forward flexibility. The boot includes an upper secured to a sole, with the upper including a vamp opening over the user's instep and the anterior side of the user's ankle. The boot further includes a tongue extending upwardly from the upper to cover the vamp opening, and a selective fastener such as a lace or strap that closes the vamp opening over the tongue. The boot includes a semi-rigid tongue stiffener insert that is selectively securable at upper and lower ends to the tongue to achieve a predetermined degree of forward ankle flexibility. The tongue stiffener can be removed altogether from the boot to provide a substantially unlimited degree of forward flexure, or it can be inserted into the boot to increase the stiffness of the boot upper to limit forward flexure. In a further aspect of the present invention, a plurality of tongue stiffeners having differing degrees of semi-rigidity is provided, and a stiffener can be selected and installed for a predetermined degree of forward flexural resistance.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
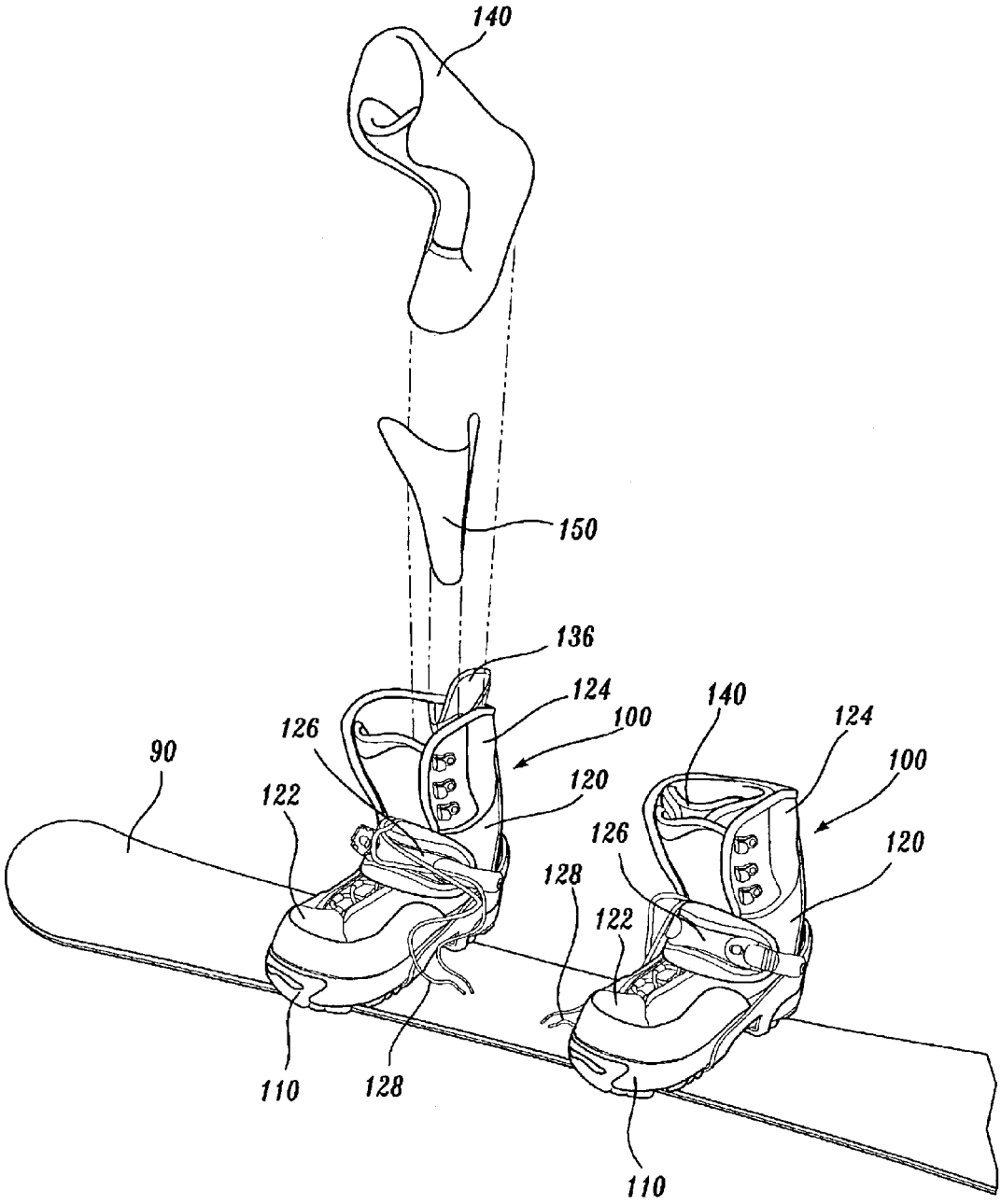
FIG. 1 is a perspective, partially exploded view of a pair of snowboard boots made in accordance with the present invention, shown atop a snowboard.

A snowboard boot made in accordance with a preferred embodiment of the present invention is illustrated in FIG. 1, which shows a perspective, partially exploded view of two snowboard boots 100 on a snowboard 90. Each snowboard boot 100 includes a sole portion 110, and a boot upper 120 that is connected to, and extends upwardly from, the sole portion 110. The boot upper 120 has a lower, or toe portion 122 that, cooperatively with the sole portion 110, generally encloses a user's foot (not shown), and a high back portion 124 that wraps around the user's ankle (also not shown). A soft, compressible liner 140, smaller than the boot 100 and generally conforming to the shape of the user's foot, is provided between the snowboard boot 100 and the user's foot, to increase the comfort of and more closely conform to the user. A strap 126 and/or laces 128 may be used to secure the snowboard boot 100 tightly about the user's foot and ankle. If step-in bindings are to be used, the sole portion 110 will further include cleats (not shown) or other engaging members on its bottom side that engage corresponding plate bindings on the snowboard 90.

The disclosed invention is adapted for use with a "soft" boot. A "soft" boot upper is typically formed of a flexible material—for example, a pliable leather, a woven fabric material such as polymeric canvas, polymeric sheet material, or a layered combination of such materials. Such flexible materials are selected to provide a relatively comfortable fit to the user and to provide a limited range of motion at the ankle joint. In particular, the high back portion 124 may be constructed from fabric, leather, elastomers, or combinations of these materials, by way of nonlimiting example. The flexible high back portion 124 of the boot and, therefore, the user's ankle, can flex or rotate about a transverse axis with respect to the toe portion 122, and therefore, the user's foot. The high back portion 124 permits fore and aft, and lateral and medial, flexure. This flexure provides a degree of mobility to the user's ankle joint, which is important in some snowboarding maneuvers, particularly in free style snowboarding. The soft boot is also typically more comfortable to the user than a hard shell boot.

As discussed above, it is sometimes desirable to provide stiffer support to the user's ankle and a more limited range of motion at the ankle joint, particularly in the aft direction, for example, to enable the user to more easily control axial rotation of the snowboard. The desired stiffness in the boot 100 will depend upon several factors, including the user's preference and skill level, the type of binding used, and on the type of snowboarding in which the user will be engaging.

Figure 2:
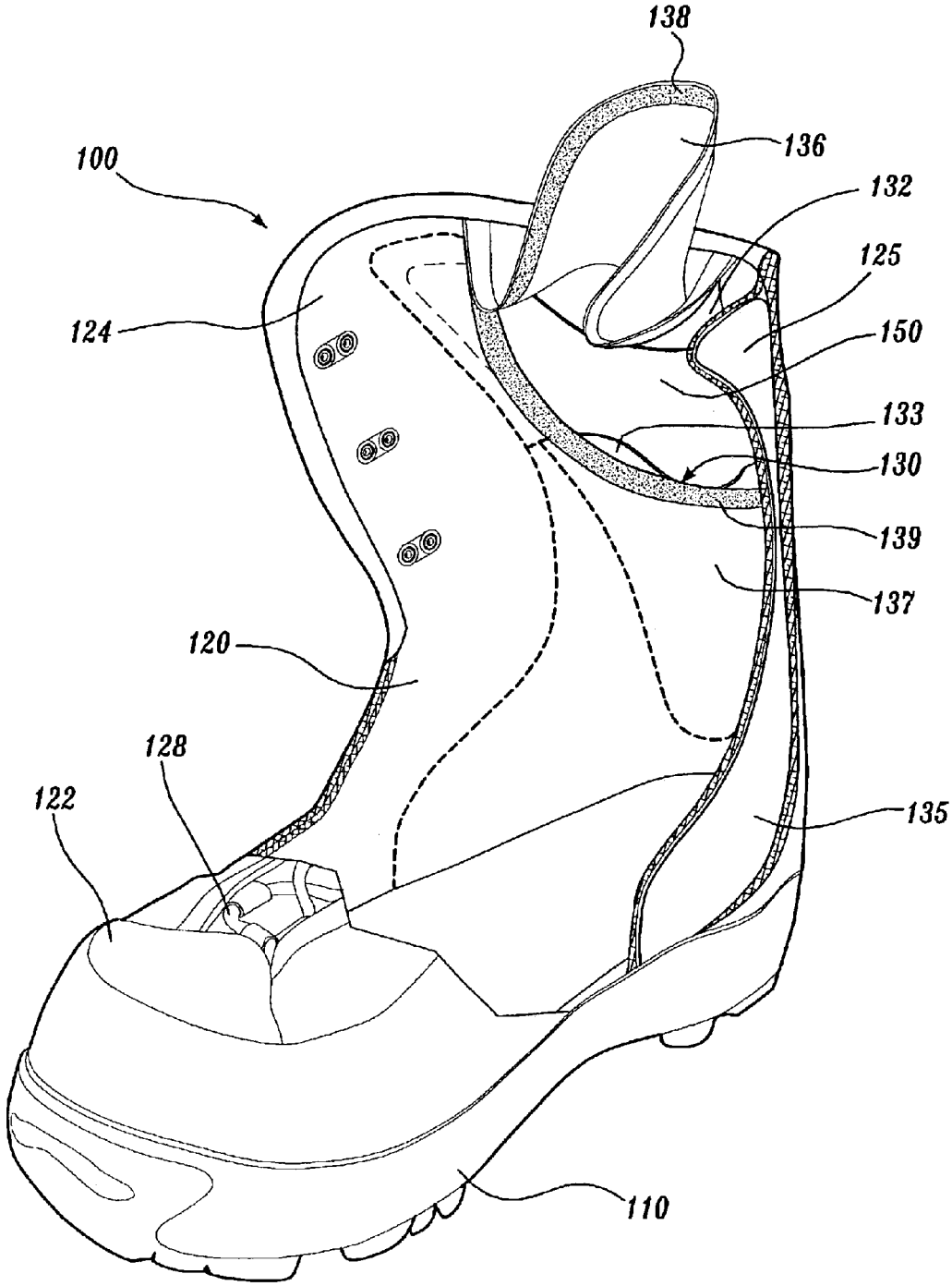
FIG. 2 is a partially cutaway perspective view of the snowboard boot shown in FIG. 1.
Figure 3:
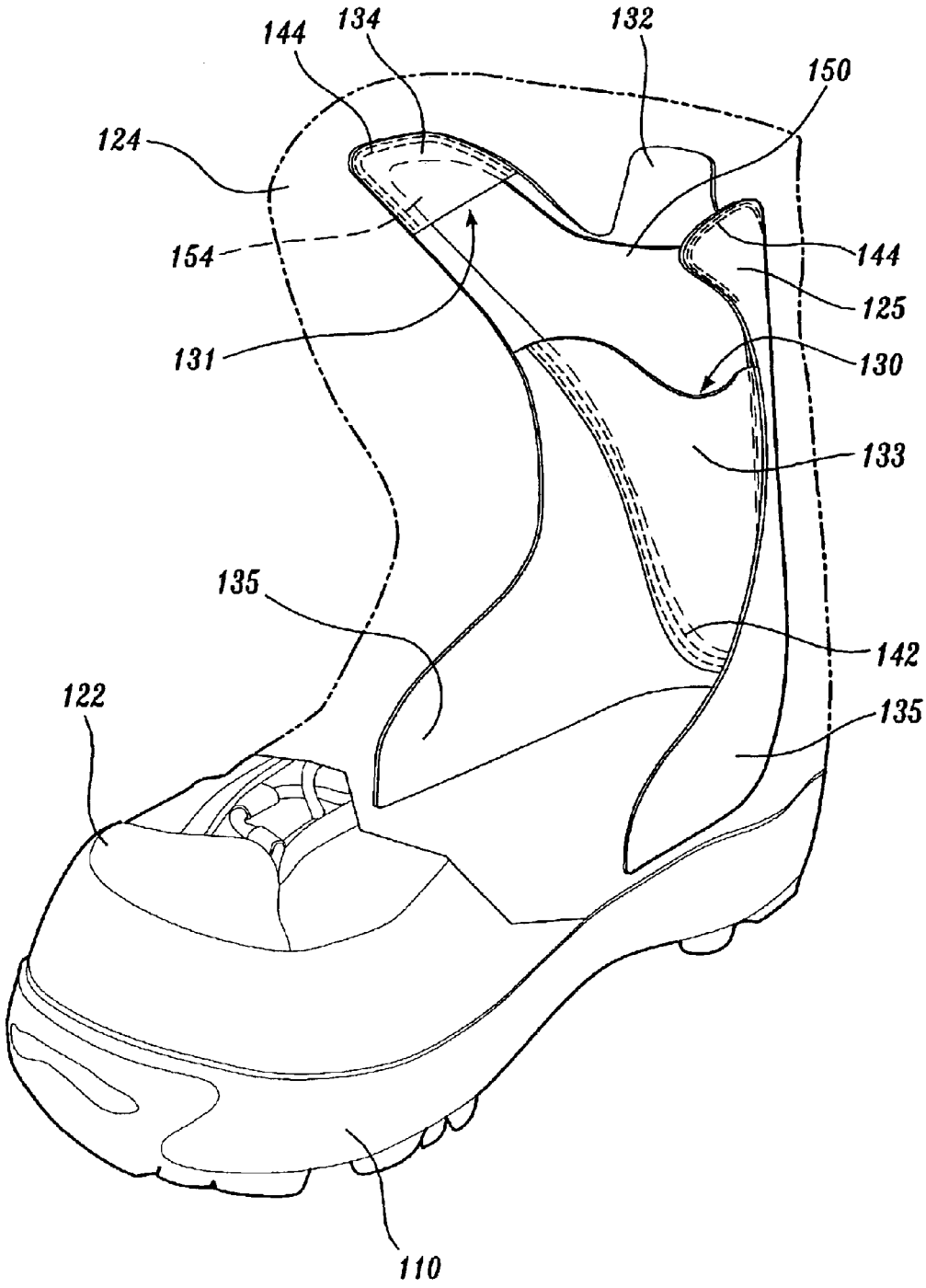
FIG. 3 is a further cutaway perspective view of the snowboard boot shown in FIG. 1.

As shown in FIGS. 1–3, the boot 100 includes a curvilinear stiffening insert 150 that is removably insertable into the boot upper 120, between the boot upper 120 and the liner 140. A pocket 130 is provided in the back interior of the boot upper 120, which slidably receives the insert 150. The pocket 130 includes a back panel 132 that is attached to, and conforms to, the boot upper 120, and a smaller front panel 133 attached to the front of the back panel 132 as discussed in more detail below. In the currently preferred embodiment, the front and back panels 132, 133 are made from a semi-rigid material, providing a predetermined degree of stiffness to the boot upper 120, although a more flexible pocket—for example, made from leather or a similarly pliable material—is also possible and contemplated by this invention. The back panel 132 is preferably attached to the boot upper 120 with an epoxy, although other attachment methods are possible and known in the art, including sewing or riveting the back panel to the upper, providing a frame that holds the back panel in place, or having the back panel formed integrally with the boot upper material.

The back panel 132 has a curvilinear profile that generally matches the desired shape of the portion of the boot upper 120 to which it is attached. It will be appreciated that the back panel 132 therefore provides the additional benefit of tending to hold the boot upper 120 in the desired shape. In the preferred embodiment illustrated, the back panel 132 also includes a lower portion that has a pair of elongate lower wings 135 extending forward from bottom edge of the back panel 132 and generally adjacent to the upper surface of the sole portion 110. The lower wings 135 cooperatively with the back portion of the sole 110 therefore form a heel cup. The lower wings 135 provide the boot 100 and the user with additional support, by generally surrounding the user's heel. Similarly, the top of the back panel 132 includes a pair of upper wings 125 that extends forwardly from the top edge of the back panel 132. The upper wings 125 wrap partially around the user's ankle, whereby the back panel 132 provides lateral or side-to-side stability to the boot upper 120 as well as forward and backward stability.

The front panel 133 is smaller than the back panel 132 and is attached to the front face of the back panel 132. In the disclosed embodiment, the front panel 133 is also semi-rigid and is sewn to the back panel 132 generally along both sides and at the bottom edge of the front panel 133. As seen most clearly in FIG. 5, the front panel 133 is shaped such that when the front panel 133 is attached to the back panel 132, the central portion of the front panel 133 is disposed forward from the back panel 132, thereby forming a pocket 130 therebetween that is open at the top. In the disclosed embodiment the pocket 130 is formed by forwardly extending sections 145 near the side edges of the front panel 133. It will be apparent to one of skill in the art that a pocket could also be formed in other ways, including by providing the front panel 133 with a radius of curvature that is greater than the radius of curvature of the back panel 132. Alternatively, the front panel 133 can simply be formed with sufficient flexibility that it can be pulled away from the back panel 132 for insertion of the insert 150. It will also be apparent that other configurations are possible, for example the pocket opening could be provided on the left or right side, and an insert provided that will slide sideways into a side pocket.

The front panel 133 is widest at the open top, and decreases uniformly in width from the top to the bottom. In the currently preferred embodiment, the front panel 133 is attached to the back panel 132 with stitches 142, generally conforming to the shape of the front panel 133, although other attachment methods could also be used. The pocket 130 is therefore open at the top, and decreases uniformly in width from the top to the bottom.

Figure 4:
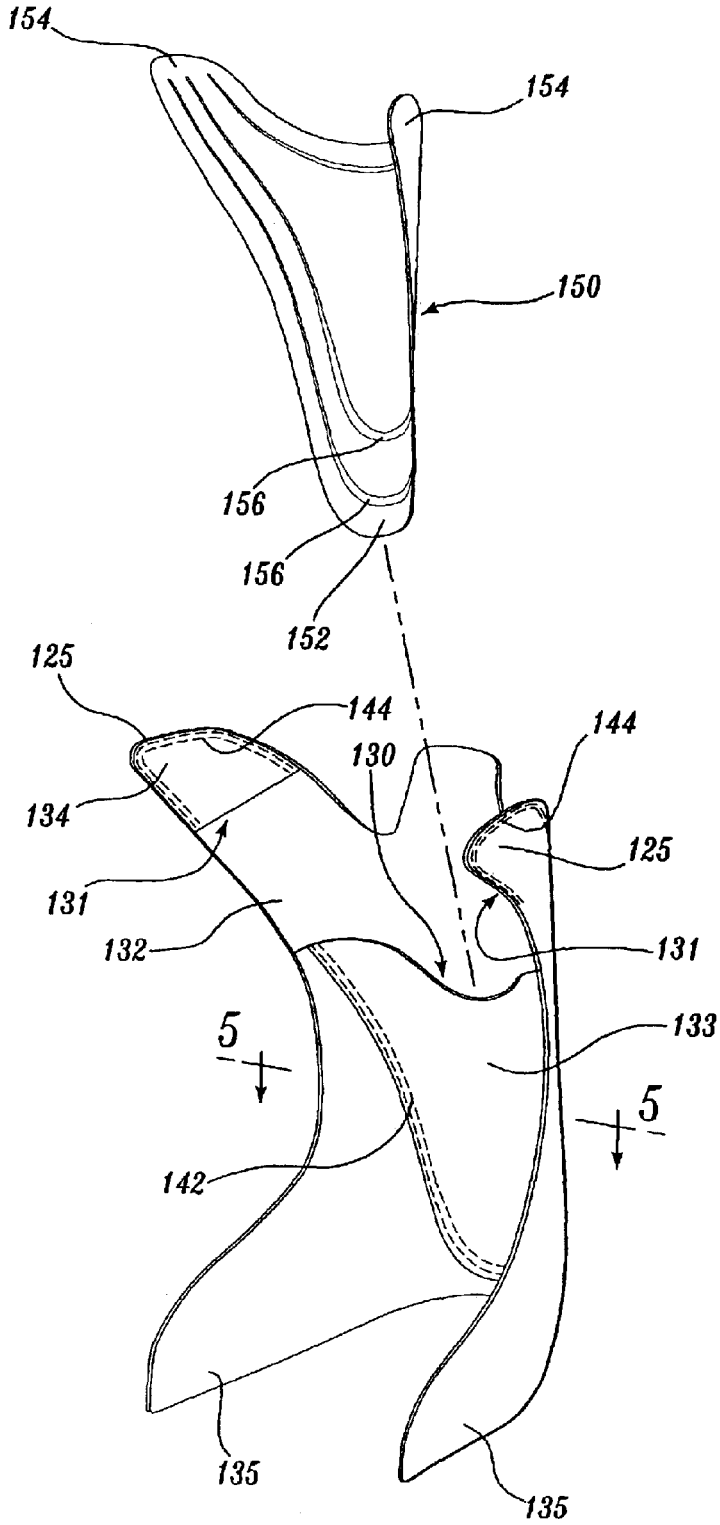
FIG. 4 is a perspective view of the pocket assembly and insert of the snowboard boot shown in FIG. 1.

Two locking strips 134 are attached at the top portion of the upper wings 125 of the back panel 132, as seen most clearly in FIG. 4. The locking strips 134 are attached generally along the upper and side edges by stitches 144, thereby forming small, downwardly-opening pockets or locking slots 131 on each side of the upper edge of the back panel 132. It will be apparent to one of skill in the art that equivalent locking slots could be provided in other ways. For example, slots could be integrally formed in the back panel by cutting slits at appropriate locations and forming a portion of the back panel above the slot to project outwardly from the face of the back panel. Alternatively, the back panel could be formed with a portion that folds over to form a locking slot. The locking slots 131 function to receive and retain the removable stiffening insert 150 in place, as discussed below.

Figure 5:
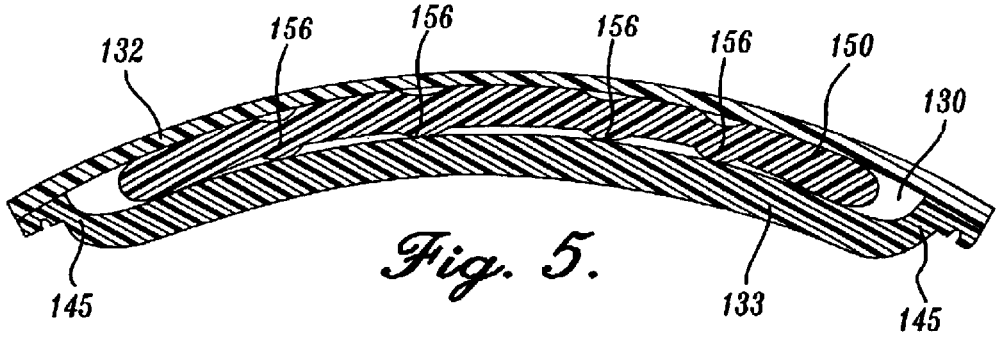
FIG. 5 is a cross-sectional view along line 5—5 of FIG. 4, showing the insert installed in the pocket.

A curvilinear, generally Y-shaped insert 150 can be removably inserted into the pocket 130, as shown in FIG. 4. The insert 150 has a narrow lower tongue 152 extending downwardly, and increases uniformly in width from the bottom of the tongue 152 to the top, where a pair of elongate sections, or locking tabs 154, extend upwardly and outwardly. FIG. 5 shows a cross sectional view of the insert 150 inserted into the pocket 130 (taken along line 5—5 of FIG. 4). The insert 150 is smaller than, and generally matches the shape of, the pocket 130, whereby the insert tongue 152 substantially fills the pocket 130. As seen most clearly in FIG. 3, the insert 150 is longer than the pocket 130, so when the insert 150 is fully inserted into the pocket 130, the top portion of the insert 150, including the pair of locking tabs 154, extends out of the top of the pocket 130.

The insert 150 is sized and shaped such that when the insert 150 is fully inserted into the pocket 130, the locking tabs 154 overlie the locking slots 131. The insert 150 and the back panel 132 have sufficient flexibility that they can be elastically deformed to allow the locking tabs 154 to be inserted into the locking slots 131, thereby locking the insert 150 in the pocket 130, and securing the insert 150 against the back of the upper 120. To lock the insert 150 into the slots 131, for example, a back panel 132 upper wing 125 is grasped (with the associated section of the upper high back portion 124) and rotated back and outward, with respect to the rest of the boot 100. The corresponding locking tab 154 of the insert 150 is grasped with the other hand and deflected back and inwardly, until the locking tab 154 slidably engages the locking slot 131. The process is then repeated on the other side.

Similarly, the back panel 132 and insert 150 can be elastically deformed to remove the locking tabs 154 from the slots 131, by repeating the steps described above and slidably disengaging the locking tabs 154 from the slots 131. It will be appreciated that the insert 150 is curved in the transverse plane, such that the insert generally matches the contours of the back panel 132 and the front panel 133. Therefore, the upper portion of the insert 150 and particularly the locking tabs 154 will partially wrap around the user's leg, just above the ankle. The insert 150 will therefore provide additional rigidity or stability in the lateral direction, that is, side to side with respect to the user, as well as forward and backward stability. It will be appreciated that the locking tabs 154 could be attached to the back panel 132 in other ways, for example, by providing snaps on the locking tabs 154 and the back panel 132, or using loop and hook-type fasteners.

Figure 6:
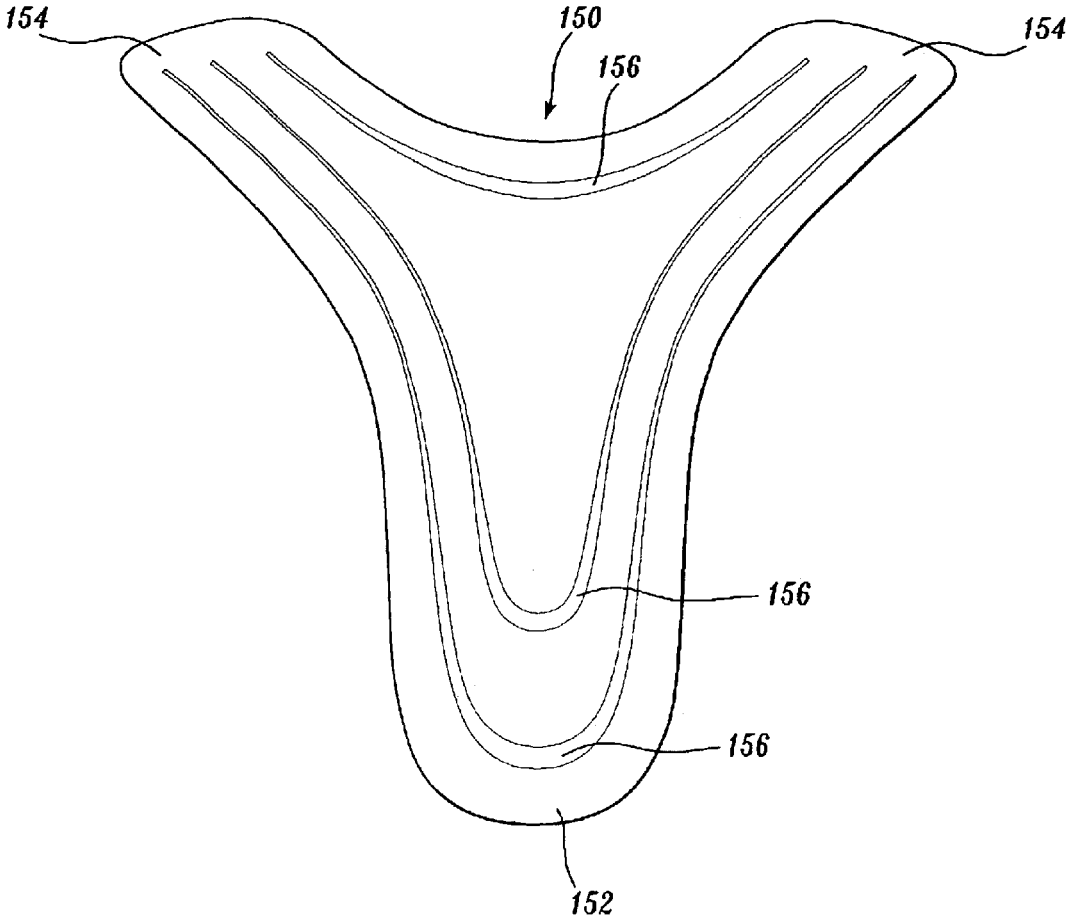
FIG. 6 is a flat pattern view of the insert of the snowboard boot shown in FIG. 1.

In the disclosed embodiment, generally vertically and transversely extending ribs 156 are provided on the insert 150, to increase the rigidity of the insert 150. As seen most clearly in FIG. 5, the ribs 156 also reduce the area of the insert 150 that contacts the interior of the pocket 130, thereby reducing the frictional forces during insertion and removal of the insert 150. FIG. 6 is a flat-pattern view of the insert 150, showing the general Y-shape of the insert. The ribs 156 generally follow the edge contour of the insert 150.

The insert 150 may be formed of any suitably semi-rigid material having sufficient strength and shape stability, including by way of non-limiting example, a semi-rigid nylon™ polymer, or a carbon fiber reinforced composite. The desired combination of rigidity and flexibility can be further selectably achieved by modifying the geometry of the insert, for example the thickness of the material or the number and/or size of surface features such as ribs 156. Although in the preferred embodiment the back panel 132 and front panel 133 are made from a similar semi-rigid material, it is also contemplated that the panels 132, 133 could be made from a more flexible material, such as a woven fiber material or leather.

A lining 137 covers the interior of the upper 120. The lining includes a flap 136 that is attached to the top of the upper 120, and provides access to the pocket 130. A hook and loop type fastener 138 is provided on the flap 136, that is alignable with a matching hook and loop type fastener 139 on the body of the liner 137, to allow the flap 136 to be secured in a closed position, whereby the liner 137 covers the back panel 132, front panel 133, and insert 150.

It will be appreciated that the present invention allows the user to selectively control the stiffness of the snowboard boots by inserting or removing the insert 150 from the pocket 130. It is contemplated that multiple inserts can be provided for a single boot, the multiple inserts having differing stiffness characteristics, whereby the user can selectively achieve varying degrees of boot upper flexibility. In particular, a snowboard boot made in accordance with the present invention could be used with different types of bindings. If the snowboarder is using the boots with a high back style binding, enhanced stiffness in the boot may not be required because the binding attached to the snowboard will provide the requisite board control. The insert 150 may be removed for such cases. Even with a high back style binding, however, the added lateral stability provided by the insert may be desirable. Alternatively, if step-in plate bindings are to be used, where greater boot stiffness is generally preferred, the snowboarder can simply slide the insert 150 into the pocket 130. An additional advantage of the present invention is that it would allow the snowboarder to spread out the cost of upgrading to step-in bindings over more than one season. If the snowboarder desired to switch to step-in bindings, for example, he or she could purchase boots made in accordance with the present invention in one season, and use them with an existing strap binding, and then upgrade the snowboard in a subsequent season.

Although the disclosed embodiment has been described having an interior pocket, it is also contemplated by the present invention that the pocket could be formed on the outside of the snow boot upper such that an insert wrapping partially around the snowboarder's ankle can be inserted into the pocket without removing the boot. This alternative embodiment would have the advantage that the interior of the boot would not have to accommodate the insert and therefore a boot without a removable liner 140 could be used.

Although the invention has been described with reference to the preferred embodiment wherein a pocket is provided in the boot to retain the insert, other means for retaining a rigid or semi-rigid insert are also contemplated within the scope of the present invention. For example, and without limitation, it is contemplated that a plurality of short retainer tabs could be provide in the boot upper to retain an insert at three or more attachment locations. Alternatively, a simple flexible flap at the top of the upper, or an elastic strap, could be employed to retain the insert cooperatively with the user's foot and/or the liner. More positive locking mechanisms, such as snaps or hooks and hoops type fasteners could also be attached to the boot upper and the insert to lock the insert at the desired location within the boot.

It should be readily apparent to those of ordinary skill in the art that additional alterations could be made to the above-described embodiment. For instance, the pocket for the insert could be formed as a unitary pocket from a single piece of material. Further, the insert could be formed with a strap, hoop, or other grasping device to facilitate insertion and/or removal of the insert from the boot. Also, a stacked, multipart insert could be used wherein the stiffness of the upper can be adjusted by changing the number of inserts that are inserted in the pocket. Although the present invention has been described with reference to snowboard boots, the application for which the invention was developed, it is also contemplated that the invention will find application in other sporting footwear in which varying degrees of-boot upper stiffness may be desired.

Figure 7:
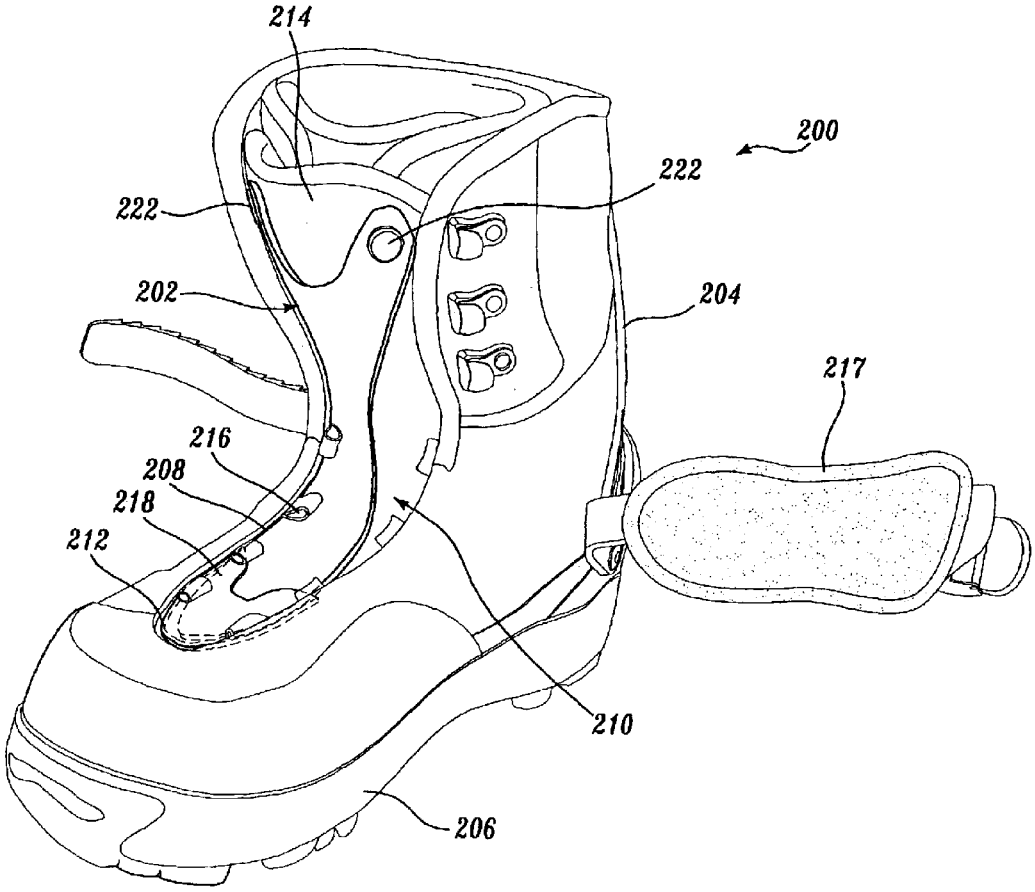
FIG. 7 illustrates an alternative embodiment of the invention, including a selectively removable tongue stiffener.
Figure 8:
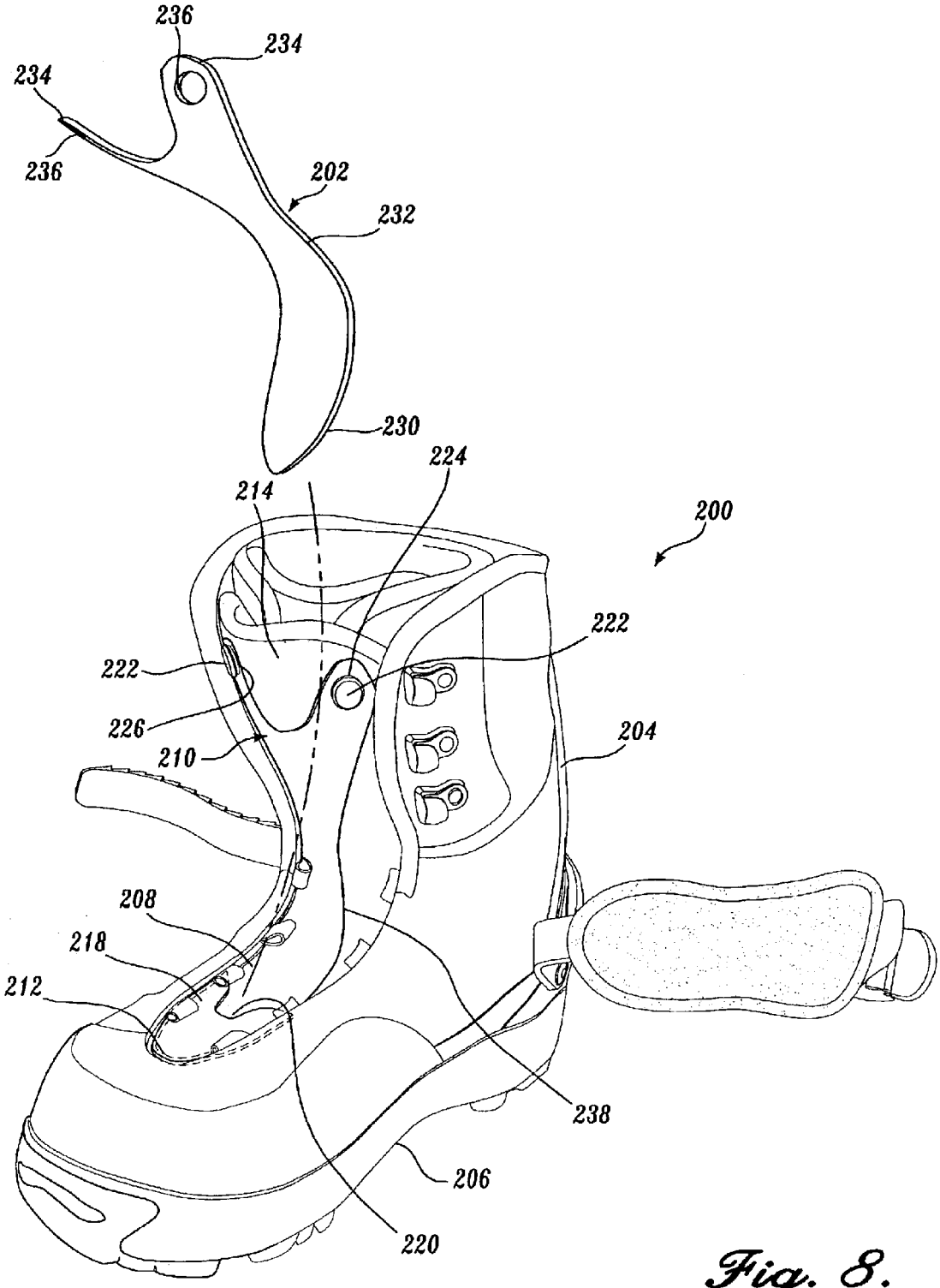
FIG. 8 provides a perspective view of the snowboard boot of FIG. 7, with the tongue stiffener exploded from the boot.

An alternative embodiment of a snowboard boot 200 constructed in accordance with another aspect of the invention is shown in FIGS. 7 and 8. The snowboard boot 200 is similar to the previously described snowboard boot 100, but rather than having a selectively removable stiffener for control and limitation of aft flexure, the snowboard boot 200 includes a selectively removable tongue stiffener 202 to allow the boot to be adapted for differing degrees of resistance to forward ankle flexure. Those aspects of the snowboard boot 200 in common with the previously described snowboard boot 100 will not be described again in detail to avoid redundancy.

Briefly, the snowboard boot 200 includes a flexible upper 204 that is joined to an outsole 206. As in the previously described embodiment, the flexible upper 204 is suitably formed from fabric such as nylon, leather, or other flexible materials, includes internal padding, and may also include an internal heel and ankle support structure (not shown). Alternately, the boot may not include an internal ankle support, instead relying on a conventional external high back carried on a snowboard binding.

The boot upper 204 includes a vamp opening 208. The vamp opening 208 is an elongate gap in the anterior side of the boot upper 204, extending along the user's instep and anterior side of the ankle. The vamp opening is covered by an elongate tongue 210. The elongate tongue 210 has a lower end 212 and an upper end 214. The lower end 212 of the tongue is stitched to the interior of the boot upper 204 at the bottom, forwardmost end of the vamp opening 208. The tongue 210 extends upwardly along the interior of the vamp opening 208, with the upper end 214 of the tongue 210 terminating above the ankle of the user. The left and right longitudinal edges of the tongue 210 are overlapped by the left and right sides of the boot upper 204 alongside the vamp opening 208. As in a conventional boot, the snowboard boot 200 also includes a selective vamp closure, such as a lacing system 216, that optionally includes a strap assembly 217 to fasten the vamp closure 208 and tighten it over the tongue 210. The tongue 210 includes an outer flexible layer and internal padding.

In the embodiment illustrated, the left and right edges of the tongue 210 are not connected to the boot upper 204, with the tongue 210 being connected only at the lower end to the boot upper 204. However, it should be readily apparent that the invention is also suitably used with a boot that includes folds along the left and right edges of the tongue that are stitched to the interior of the boot upper 204. Additionally, the invention may be used with a boot having no vamp opening, instead including a side or rear access aperture.

The tongue stiffener 202, or other semi-rigid insert, can be either installed on the tongue 210, as shown in FIG. 7, or selectively removed from the tongue 210, as shown in FIG. 8. Once so removed from the boot, the tongue 210 has an overall conventional construction. However, the tongue 210 includes mounting structures that provide for installation of the tongue stiffener 202. Specifically, a pocket 218 is formed on the outer surface of the lower end 212 of the tongue 210. The pocket 218 is constructed from a flap of material, such as a semi-rigid plastic sheet or a section of fabric, secured about its lower edge and sides to the tongue, such as by stitching or by an adhesive. Alternately, the flap 218 can be integrally formed as a portion of one of the fabric or other material layers of the tongue. An opening 220 exists on the upper side of the pocket 218, and in the preferred embodiment illustrated, the opening 220 is recessed in the center of the tongue.

The upper end 214 of the tongue includes first and second snap fasteners 222. The snap fasteners are secured to the left and right sides of the upper end 214 of the tongue 210, adjacent the left and right sides of the vamp opening 208. Each of the snap fasteners 222 includes an enlarged head 224 that projects radially outward from a slightly smaller base 226. The base 226 is secured to the upper end 214 of the tongue 210. In a preferred embodiment, the base includes an annular flange that is received under an outer layer of the tongue, and is stitched to the tongue, with the head 224 projecting from an aperture formed in the outer layer. This anchors the snaps 222 in place so that they are non-removably affixed to the tongue 210. The purpose of the pocket 218 and the first and second snaps 222 is to allow for selective installation of the tongue stiffener 202. However, when the tongue stiffener 202 is not in position, they do not limit or impact the function of the boot 200, and in particular do not limit or provide any substantial resistance to forward flexure of the ankle portion of the boot. Thus when so removed, the boot freely flexes forwardly.

Referencing FIGS. 7 and 8, the tongue stiffener 202 has a generally elongate Y-shaped configuration. The tongue stiffener 202 is formed from a compound curvilinear sheet. The tongue stiffener 202 has a lower pointed end 230, a longitudinal center body 232 that decreases in width at a centermost point, and an upper end that bifurcates into left and right upper forks 234. The left and right forks 234 of the upper end of the tongue stiffener 202 thus form the tops of the "Y." Overall, the tongue stiffener 202 is narrowest at its center point which, when the tongue stiffener 202 is installed, corresponds generally to the arcuate joinder of the instep and anterior ankle surface of the user's foot. In an unflexed configuration, the tongue stiffener 202 is curved at this center point. Additionally, the entire tongue stiffener is curved three dimensionally to match the contour of the user's foot and ankle.

Just as for the previously described inserts 150, the tongue stiffener 202 is suitably formed from a semi-rigid material having a predetermined degree of strength, shape stability, and resilient flexibility. Suitable materials include thermoplastic polymers such as hytrel™ and nylon™ polyamides. In order to provide a predetermined degree of resistance to forward flexure of the boot, suitable materials having varying degrees of semi-rigidity, such as a shore D hardness of 50 to 100, or higher or lower, may be selected. Other suitable materials, such as spring steel, are also within the scope of the present invention, providing they have the desired predetermined degree of flexibility.

To install the tongue stiffener 202, the vamp closure 216 is opened, exposing the anterior face of the tongue 210. The lower end 230 of the tongue stiffener 202 is then inserted into the interior of the pocket 218 on the tongue 210. An aperture 236 is formed through the center of each upper fork 234 of the tongue stiffener 202. The apertures 236 align with the snap fasteners 222 when the tongue stiffener 202 is installed in place over the interior face of the tongue 210. The apertures 236 have a diameter slightly less than the diameter of the heads 224 of the snap fasteners 222, and the material from which the tongue stiffener 202 is formed has sufficient resiliency to deform about the heads 224 when the tongue stiffener 202 is pushed down to engage the snap fasteners 222 within the apertures 236.

As so installed, the tongue stiffener 202 is selectively secured or anchored both at the upper end and at the lower end to the tongue 202. The resilient tongue stiffener 202 provides resistance to forward flexure of the ankle of the user of the snowboard, increasing the stiffness of the boot upper 204 in the forward direction. Because of the lateral and medial extensions of the upper forks 234 of the stiffener 202, a predetermined degree of lateral and medial stiffness is also imparted to the boot. Lateral and medial flexure of the boot upper requires torsional deformation of the tongue stiffener 202. A recess 238 is formed in the anterior surface of the tongue 210, which generally conforms to the shape of the tongue stiffener 202, so that the tongue stiffener 202, when installed, lies flush on the tongue and does not bulge out forwardly, for aesthetics and better fit.

The degree of forward flexure resistance and torsional rigidity provided by the tongue insert 202 may be varied, as noted above, by selecting different materials for the tongue. Likewise, the thickness of the tongue stiffener 202 may be varied to increase or decrease stiffness, and the width of the tongue stiffener 202, particularly at the center section 232, may also be varied to change the stiffness and torsional stability. Further, grooves or ribs may be formed in the tongue stiffener 202 to strengthen (in the case of ribs) or increase the flexibility (in the case of grooves) of the tongue stiffener 202.

In the preferred embodiment, the tongue 202 is anchored and seated at both the forward and upper ends. Other mechanisms of mounting the tongue stiffener 202 may be utilized. Thus, rather than snaps at the top and a pocket at the bottom, snaps may be included at both upper and lower ends, or pockets at both upper and lower ends. Greater or fewer snaps, such as four snaps (two top and two bottom), or two snaps (one top and one bottom), or other fasteners, such as clips, may be utilized. Further, the entire tongue stiffener 202 may be received within a full-length pocket, with a closure added as in the previously described boot 100 to anchor or seat the tongue stiffener 202 in position. A user may be provided with a selection of tongue stiffeners 202 of varying stiffnesses to allow the user to "dial in" or finely tune the forward flexibility and torsional stiffness of the boot for differing riding conditions.

While the previously described tongue stiffener 202 is made of a uniform material and thickness, different regions of the tongue stiffener 202 may be varied to impact the performance of the boot. Thus, for example, the left or right fork 234 of the tongue stiffener 202 may be increased or decreased in thickness or otherwise changed in shape so that the boot is able to flex more medially than it is laterally, or vice versa. Thus, the stiffener 202 can be configured with portions of differing thickness or stiffness to correct for a given torsional stability in the lateral direction relative to the medial direction.

As compared to other boot stiffeners, the tongue stiffener 202 is retained securely in place during use, does not impact normal tightening and loosening of the boot using the vamp fastener, and does not increase the bulkiness of the boot. While the tongue stiffener 202 has been described as being mounted on the anterior surface of the tongue 210, the tongue stiffener 202 could alternately be mounted on the posterior (interior) surface, or within an interior pocket, of the tongue 210.

Figure 9:
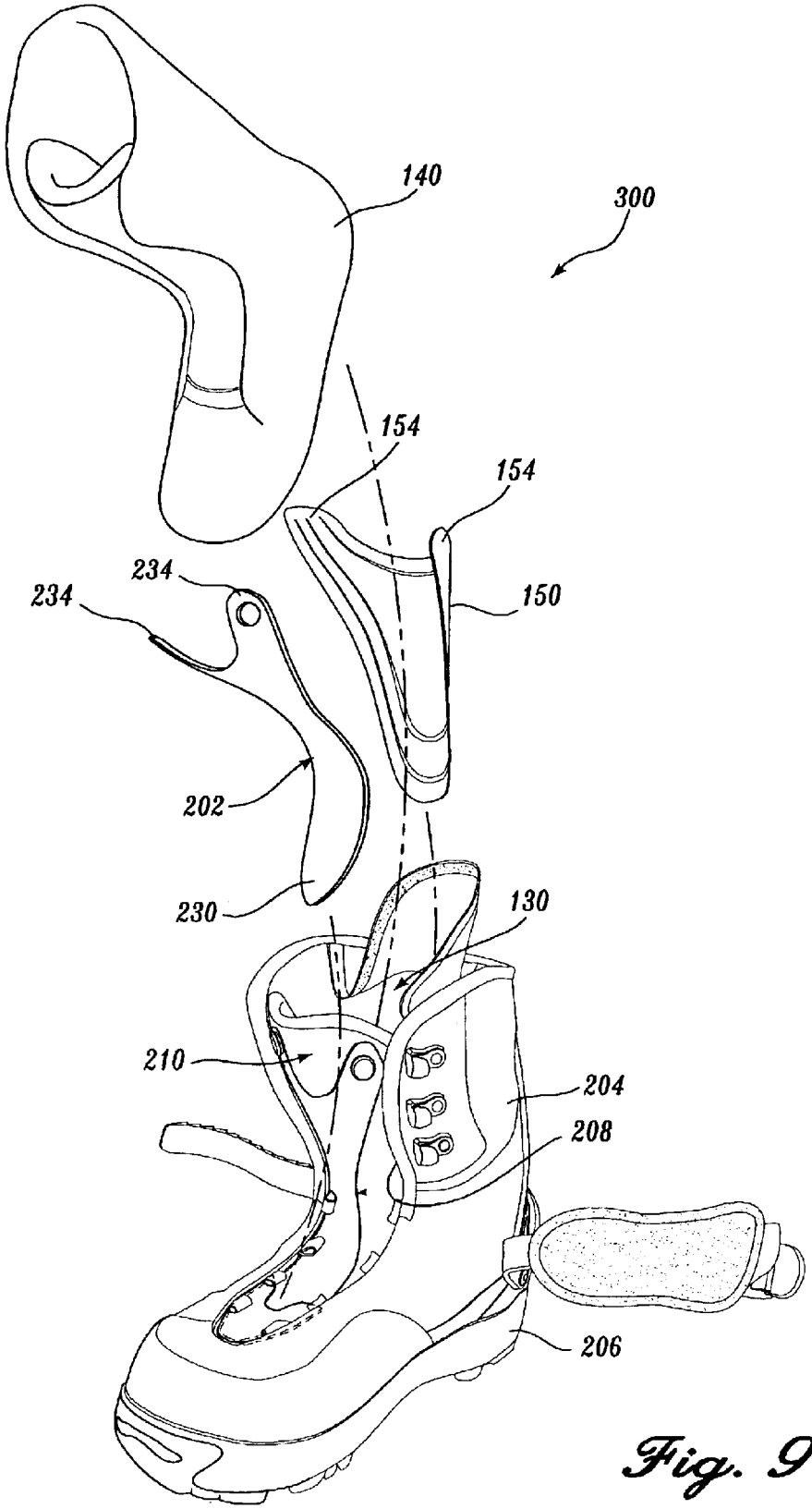
FIG. 9 is an exploded view of another embodiment of a snowboard boot according to the present invention, utilizing both forward and rearward semi-rigid supports.

Another embodiment of the present invention is shown in FIG. 9, which shows a sports boot, such as a snowboarding boot 300, having an outsole 206 and a flexible, high back upper 204 defining a rearwardly disposed pocket 130, and a forwardly disposed vamp opening 208 and tongue 210. As discussed below, the boot 300 is adapted to selectively receive an ankle support system comprising both forward and rearward ankle support inserts, providing the user with the ability to customize both the forward and backward stiffness and the lateral stiffness of a boot, and permitting the same boot to be used for a variety of different conditions.

Referring still to FIG. 9, this embodiment includes a rearward support construction similar to the first embodiment shown generally in FIG. 1, wherein a pocket 130 in the boot 300, formed by back panel 132 and front panel 133, is adapted to receive one or more stiffening inserts 150 at the rearward portion of the upper 204. The insert 150 is generally triangular or Y-shaped, with the widest portion defined by the locking tabs 154 near the top of the insert 150. The insert 150 is also curvilinear, approximately conforming to the shape of the upper 204 (and hence the user's leg) at the pocket 130. When in use, locking tabs 154 on the insert 150 extend forwardly to generally conform to, and wrap about, the back and a portion of the sides of the user's leg (not shown), providing lateral support as well as rearward support to the user's ankle. Other aspects of the pocket 130 and insert 150 may be generally the same as the correspondingly numbered elements described above. It will be appreciated that although the insert 150 is shown extending along approximately half of the upper 204 circumference near the top of the upper 204, it is contemplated that the locking tabs 154 may extend further about the upper, including, for example, substantially around the entire circumference of the upper edge of the upper 204.

The boot 300 also includes a forward support structure similar to the second embodiment described above (see, FIG. 7), wherein the tongue 210 is adapted to receive a forward tongue stiffener 202. The tongue stiffener 202 is again generally Y-shaped, having upper left and right forks 234. The tongue stiffener 202 is generally curvilinear, to conform to the tongue 210, including a lower portion 230 that extends forwardly, and the left and right forks 234 that extend generally rearwardly, conforming approximately to the shape of the tongue, and therefore wrapping about the front and a portion of the sides of the user's leg. Other aspects of the tongue 210 and tongue stiffener 202 are generally the same as the correspondingly numbered elements described above.

It will be appreciated now that the ankle stiffening system, including the insert 150 and the tongue stiffener 202, cooperatively defines a semi-rigid support that extends substantially around the leg of the user, i.e., cooperatively encircling more than half of the user's leg at an axial location near the top of the high back upper 204. The insert 150 and stiffener 202 extend downwardly, tapering along the leg and foot of the user.

Figure 10:
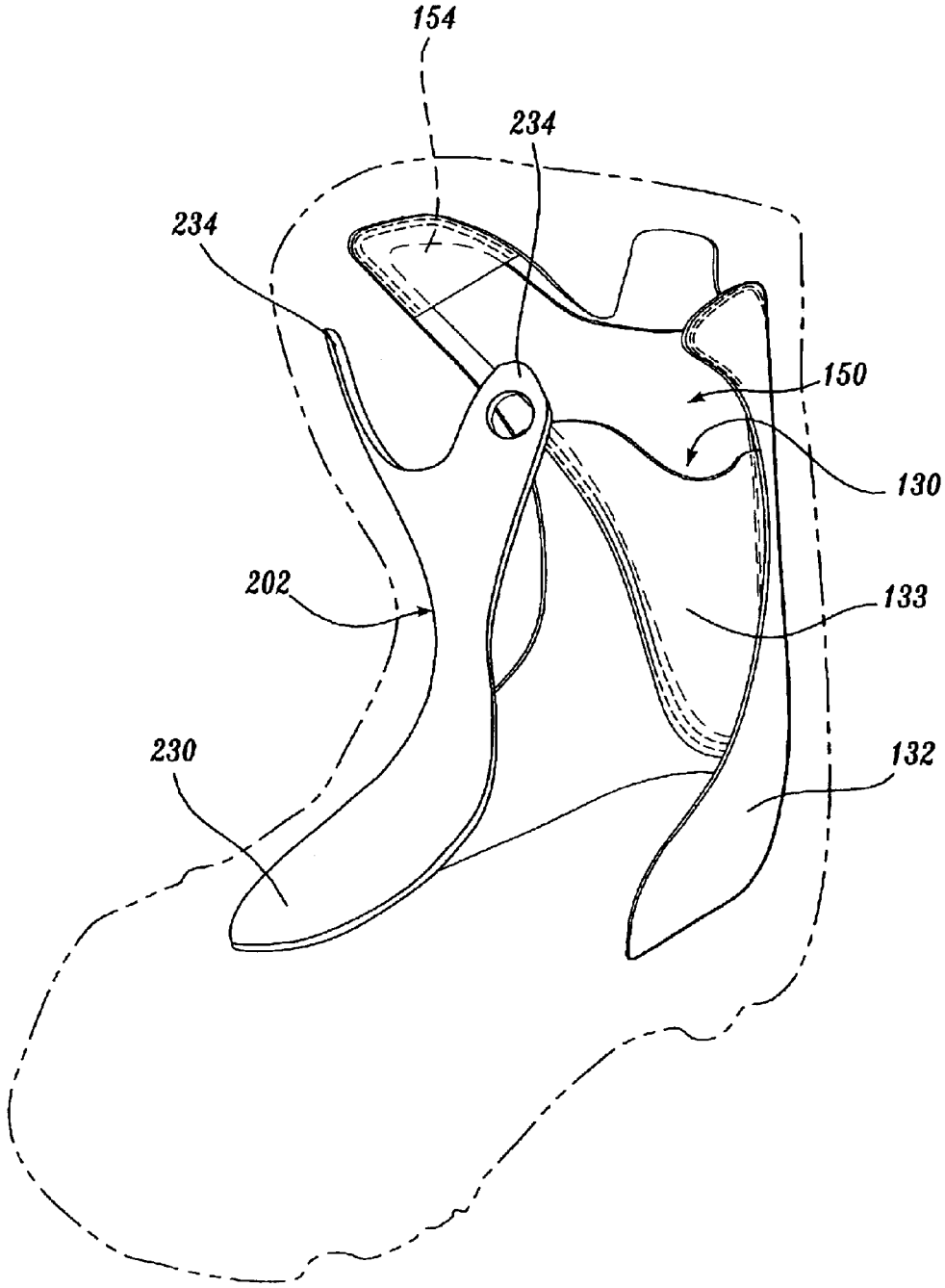
FIG. 10 shows the insert and stiffener of the embodiment of FIG. 9, with the boot shown in phantom.

As shown most clearly in FIG. 10, the insert 150 and tongue stiffener 202 substantially encircle a portion of the user's leg (not shown) and partially enclose the user's ankle (not shown), providing the user with great control in selectively adjusting the stiffness of the ankle portion of the boot 300 by selecting the desired insert 130 and/or tongue stiffener 202. The length of the left and right forks 234 on the tongue stiffener 202 may be designed to generally meet, or even overlap, a portion of the top of the locking tabs 154 of the insert 150, or (as shown in FIG. 10) the insert 150 and tongue stiffener 202 may be designed such that a gap remains therebetween during use. As discussed above, multiple inserts 150 and stiffeners 202 having various degrees of stiffness may be provided. The stiffness of the inserts 150 and stiffeners 202 may be varied, for example, by varying the material, thickness, and/or geometry (such as by adding grooves or ridges) of the inserts 150 and/or stiffeners 202. Also, it is also contemplated that more than one insert 130 and/or stiffener 202 may be used at the same time to selectively adjust the flexibility of the upper 204. Additionally, for a particular run, snow condition, or style of snowboarding, the user may elect to remove either one, or even both, of the insert and stiffener. These elements may then be re-attached when the user desired greater stiffness and support of the ankle.

While the preferred embodiment of the invention has been illustrated and described, it will be appreciated that various changes can be made therein without departing from the spirit and scope of the invention.

The embodiments of the invention in which an exclusive property or privilage is claimed are defined as follows:

1. A sports boot comprising:

a flexible upper portion adapted to receive the foot and ankle of a user, the upper portion including an elongate vamp opening along the instep and anterior ankle of the user and a high back portion adapted to wrap about the ankle of the user, the upper portion further including a tongue disposed generally along the elongate vamp opening;

a sole joined to the upper portion; and an ankle support system including:

(a) a semi-rigid posterior insert removably attached to the high back portion of the upper, the semi-rigid posterior insert being contoured to partially wrap about the user near a top edge of the upper portion; and (b) a semi-rigid anterior stiffener removably attached to the tongue, the semi-rigid anterior stiffener being contoured to partially wrap about the user near the top edge of the upper portion.

2. The sports boot of claim 1, wherein the upper portion includes an interiorly disposed pocket formed in the high back portion of the upper portion, the pocket adapted to receive the posterior insert.

3. The sports boot of claim 2, wherein the semi-rigid anterior stiffener extends from a lower end of the instep to above the ankle of the user.

4. The sports boot of claim 2, wherein the semi-rigid anterior insert and posterior stiffener are generally Y-shaped, with a curvilinear profile.

5. The sports boot of claim 2, wherein the semi-rigid anterior stiffener is attached to an anterior side of the tongue.

6. The sports boot of claim 2, wherein the tongue further comprises a pocket, and wherein at least one end of the semi-rigid anterior stiffener is secured to the tongue by being received within the tongue pocket.

7. The sports boot of claim 6, wherein an opposite end of the semi-rigid anterior stiffener is secured to the tongue with at least one snap fastener.

8. The sports boot of claim 1, further comprising a plurality of semi-rigid anterior stiffeners and a plurality of semi-rigid posterior inserts, each stiffener and insert having a predetermined degree of flexibility to permit selective adjustment of the flexibility of the snowboard boot upper.

9. The sports boot of claim 1, wherein the semi-rigid anterior stiffener and the semi-rigid posterior insert are adapted to cooperatively wrap most of the way around a user's leg at an axial location.

10. The sports boot of claim 1, wherein the semi-rigid anterior support and the semi-rigid posterior supports are formed from a thermoplastic polymer having a shore D hardness of 50 to 100.

11. A snowboard boot comprising:

a high back upper having a tongue and a posterior pocket;

an outsole joined to the upper; and an ankle support system comprising a semi-rigid insert adapted to be inserted into the posterior pocket of the upper, and a semi-rigid stiffener adapted to be releasably attached to the tongue;

wherein an upper portion of the semi-rigid insert is contoured to wrap around a posterior portion of a user's leg above the ankle and an upper portion of the semi-rigid stiffener is contoured to wrap around an anterior portion of the user's leg above the ankle, such that the insert and stiffener extend circumferentially around most of the user's leg above the ankle.

12. The snowboard boot of claim 11, wherein the stiffener is releasably attached to the tongue with a plurality of snap elements.

13. The snowboard boot of claim 12, wherein the upper further comprises an anterior pocket disposed near a lower end of the tongue, the anterior pocket adapted to receive a portion of the stiffener.

14. The snowboard boot of claim 11, wherein the stiffener and the insert are generally Y-shaped.

15. A snowboard boot comprising:

an upper portion for receiving the foot and ankle of a user, the upper portion including an elongate vamp opening along the instep and anterior ankle of the user, the upper portion being configured to permit forward flexure of the user's ankle;

a tongue secured to the upper portion and positionable to cover the vamp opening;

an outsole joined to the upper portion;

a vamp fastener carried on the upper portion for selective closure of the vamp opening; and a removable ankle support system including a semi-rigid posterior insert that is contoured to extend along the posterior of the user's ankle, and a semi-rigid anterior stiffener that is contoured to extend along the anterior of the user's ankle;

wherein the semi-rigid posterior insert and the semi-rigid anterior stiffener are adapted to cooperatively encircle a substantial portion of the user's leg above the ankle.

16. The snowboard boot of claim 15, wherein the ankle support system further comprises a plurality of interchangeable semi-rigid anterior stiffeners.

17. The snowboard boot of claim 16, wherein the ankle support system further comprises a plurality of interchangeable semi-rigid posterior inserts.

18. The snowboard boot of claim 15, wherein the upper portion further comprises an anterior pocket adapted to receive at least a portion of the anterior stiffener, and a posterior pocket adapted to receive at least a portion of the posterior insert.

* * * * *